US009410507B2

(12) United States Patent
Pearce et al.

(10) Patent No.: US 9,410,507 B2
(45) Date of Patent: Aug. 9, 2016

(54) METHOD AND SYSTEM FOR DETECTING PHEV EVAP SYSTEM RECIRCULATION TUBE RELIABILITY

(71) Applicant: FORD GLOBAL TECHNOLOGIES, LLC, Dearborn, MI (US)

(72) Inventors: Russell Randall Pearce, Ann Arbor, MI (US); Dennis Seung-Man Yang, Canton, MI (US); Aed M. Dudar, Canton, MI (US)

(73) Assignee: FORD GLOBAL TECHNIOLOGIES, LLC, Dearborn, MI (US)

( * ) Notice: Subject to any disclaimer, the term of this patent is extended or adjusted under 35 U.S.C. 154(b) by 326 days.

(21) Appl. No.: 14/034,490

(22) Filed: Sep. 23, 2013

(65) Prior Publication Data

US 2015/0083088 A1 Mar. 26, 2015

(51) Int. Cl.
*F02M 37/20* (2006.01)
*F02M 25/08* (2006.01)

(52) U.S. Cl.
CPC ..... *F02M 25/0809* (2013.01); *F02M 25/0854* (2013.01); *F02M 25/0872* (2013.01)

(58) Field of Classification Search
CPC ..... F02M 25/0809; F02M 25/0854; F02M 25/0836; F02M 25/0872
USPC ..... 123/516, 519, 518; 73/204.11, 114.39; 701/34.4, 29.7; 141/59, 44
See application file for complete search history.

(56) References Cited

U.S. PATENT DOCUMENTS 4,762,156 A * 8/1988 Rich ..... F02M 25/0836 141/286
4,862,856 A * 9/1989 Yokoe ..... B60K 15/03504 123/519
4,919,103 A * 4/1990 Ishiguro ..... B60K 15/03504 123/509
4,962,744 A * 10/1990 Uranishi ..... F02M 25/0809 123/198 D
5,570,672 A * 11/1996 Kunimitsu ..... B60K 15/035 123/516
5,819,796 A * 10/1998 Kunimitsu ..... B60K 15/04 123/519
5,850,819 A * 12/1998 Kunimitsu ..... F02M 25/089 123/516
8,935,044 B2 * 1/2015 Yang ..... G07C 5/00 123/518
9,050,885 B1 * 6/2015 Dudar ..... B60K 11/085
2004/0099254 A1 * 5/2004 Belanger, Jr. ..... F02M 25/0809 123/520
2004/0250796 A1 * 12/2004 Veinotte ..... F02M 25/0854 123/520
2009/0120064 A1 * 5/2009 Uhrich ..... F01N 5/02 60/278
2014/0324284 A1 * 10/2014 Glinsky ..... G07C 5/006 701/34.4
2014/0352796 A1 * 12/2014 Dudar ..... B60K 15/035 137/15.01
2014/0360260 A1 * 12/2014 Dudar ..... G01F 23/22 73/204.11
2015/0019066 A1 * 1/2015 Dudar ..... F02M 25/0809 701/29.7
2015/0068498 A1 * 3/2015 Peters ..... F02M 25/0854 123/520
2015/0083088 A1 * 3/2015 Pearce ..... F02M 25/0809 123/520
2015/0176541 A1 * 6/2015 Nagasaku ..... F02M 25/089 123/520
2015/0226138 A1 * 8/2015 Yang ..... F02D 41/004 701/22

* cited by examiner

*Primary Examiner* — Lindsay Low
*Assistant Examiner* — George Jin
(74) *Attorney, Agent, or Firm* — Joseph E. Root

(57) ABSTRACT

A method for detecting blockage within a recirculation tube of the evaporative emission control system of a PHEV measures the rise in interior temperature of a canister of the EVAP system, during the process of refueling, and notes an initial state of loading of the canister before refueling, indicative of the amount of hydrocarbons contained within the canister It is inferred that the recirculation tube is operative reliably if the rise in canister temperature is below a pre-determined temperature value.

3 Claims, 4 Drawing Sheets

Prior-art

A

METHOD AND SYSTEM FOR DETECTING PHEV EVAP SYSTEM RECIRCULATION TUBE RELIABILITY

TECHNICAL FIELD

Embodiments of the present disclosure generally relate to Evaporative Emission Control Systems (EVAP) for automotive vehicles, and, more specifically, to recirculation tubes disposed within EVAP systems.

BACKGROUND

Gasoline, used as an automotive fuel in many automotive vehicles, is a volatile liquid subject to potentially rapid evaporation, in response to diurnal variations in the ambient temperature. Thus, the fuel contained in automobile gas tanks presents a major source of potential evaporative emission of hydrocarbons into the atmosphere. Such emissions from vehicles are termed 'evaporative emissions'. The engine produces such vapors even if it is turned off.

Industry's response to this potential problem has been the incorporation of evaporative emission control systems (EVAP) into automobiles, to prevent fuel vapor from being discharged into the atmosphere. EVAP systems include a canister (the carbon canister) containing adsorbent carbon) that traps fuel vapor. Periodically, a purge cycle feeds the captured vapor to the intake manifold for combustion, thus reducing evaporative emissions.

Hybrid electric vehicles, including plug-in hybrid electric vehicles (HEV's or PHEV's), pose a particular problem for effectively controlling evaporative emissions with this kind of system. Although hybrid vehicles have been proposed and introduced having a number of forms, these designs share the characteristic of providing a combustion engine as backup to an electric motor. Primary power is provided by the electric motor, and careful attention to charging cycles can result in an operating profile in which the engine is only run for short periods. Systems in which the engine is only operated once or twice every few weeks are not uncommon. Purging the carbon canister can only occur when the engine is running, of course, and if the canister is not purged, the carbon pellets can become saturated, after which hydrocarbons will escape to the atmosphere, causing pollution.

A recirculation tube is an integral part of an EVAP system, and it is coupled to the fuel filler neck and the canister. During refueling, the recirculation tube recirculates fuel vapors into the fuel tank, rather than to the canister, which permits the canister size to be minimized. For vehicles having a bottom feeding fuel tank, vapor communication to the fuel filler neck may become blocked by the fuel at high fuel levels, which could cause leaks in the fuel cap area to be left undetected. Therefore, if a blockage occurs in the recirculation tube, the EVAP leakage detections systems may false pass any leakage in the fuel cap area. Therefore, monitoring the reliable operation of recirculation tubes is imperative in EVAP systems.

Considering the problems mentioned above, and other shortcomings in the art, there exists a need for an efficient system and method for identifying presence of any blockage in the recirculation tube of an EVAP system within a vehicle.

SUMMARY

The present disclosure provides a system and a method for identifying blockage within a recirculation tube of EVAP system of a plug-in hybrid electric vehicle.

According to an aspect, the present disclosure provides a method for verifying reliable operation of a recirculation tube within an EVAP system. The recirculation tube has a first end connected to a fuel filler neck of the vehicle fuel system, and a second end connected to a canister of the EVAP system. The method detects refueling, and measures any rise in canister temperature during refueling. It is inferred that the recirculation tube is operating reliably if a rise in canister temperature during refueling is below a pre-determined temperature value.

According to another aspect, this disclosure provides an evaporative emission control system for a vehicle, configured to verify reliable operation of a recirculation tube of the system. The system includes a canister connected to the fuel tank of the vehicle, and multiple temperature sensors positioned within the canister, which measure canister temperature. The recirculation tube has a first end connected to a fuel-filler neck of the vehicle fuel system; a second end connected to the canister, and is configured to recirculate fuel vapors into the fuel tank during refueling. A processor is coupled to the temperature sensors disposed within the canister. The processor indicates that the recirculation tube is operating reliably if the canister temperature rises by less than a pre-determined temperature value.

Additional aspects, advantages, features and objects of the present disclosure would be made apparent from the drawings and the detailed description of the illustrative embodiments construed in conjunction with the appended claims that follow.

DETAILED DESCRIPTION OF ILLUSTRATIVE EMBODIMENTS

The following detailed description illustrates aspects of the disclosure and its implementation. This description should not be understood as defining or limiting the scope of the present disclosure, however, such definition or limitation being solely contained in the claims appended to the specification. Although the best mode of carrying out the invention has been disclosed, those in the art would recognize that other embodiments for carrying out or practicing the invention are also possible.

Environmental regulators are steadily tightening the standards for vehicle vapor emissions. Environmental authorities in certain regions, such as Calif., typically require less than about 500 mg of hydrocarbons released as vehicle evaporative emissions in a standard 3 day test. Given other sources of emissions, the standard effectively limits canister emissions to less than about 200 mg. Euro 5/6 regulations enforce a limit of about 2 grams of evaporative emissions per day. Such stringent conditions demand a highly efficient and effective evaporative emission control system, which in turn should by leakage free.

The On-Board Diagnostic regulations mandate that the EVAP system of a vehicle should be regularly checked for leakage. Conventional EVAP systems have a recirculation tube, which recirculates fuel vapors during the process of refueling. By recirculating the fuel vapors, the recirculation tube helps maintaining appropriate size of carbon pellets within the canister of the EVAP system, and saves cost, as activated carbon pellets are obviously more expensive. Any blockage within the recirculation tube can be problematic as that may leave hamper identification of any leakage being present within the fuel filler cap area, and therefore, may increase evaporative emissions. Further, blockage within the recirculation tube may cause the canister to adsorb comparatively more hydrocarbon vapors, leading to the failure of the EVAP system to comply with emission norms.

Figure 1:
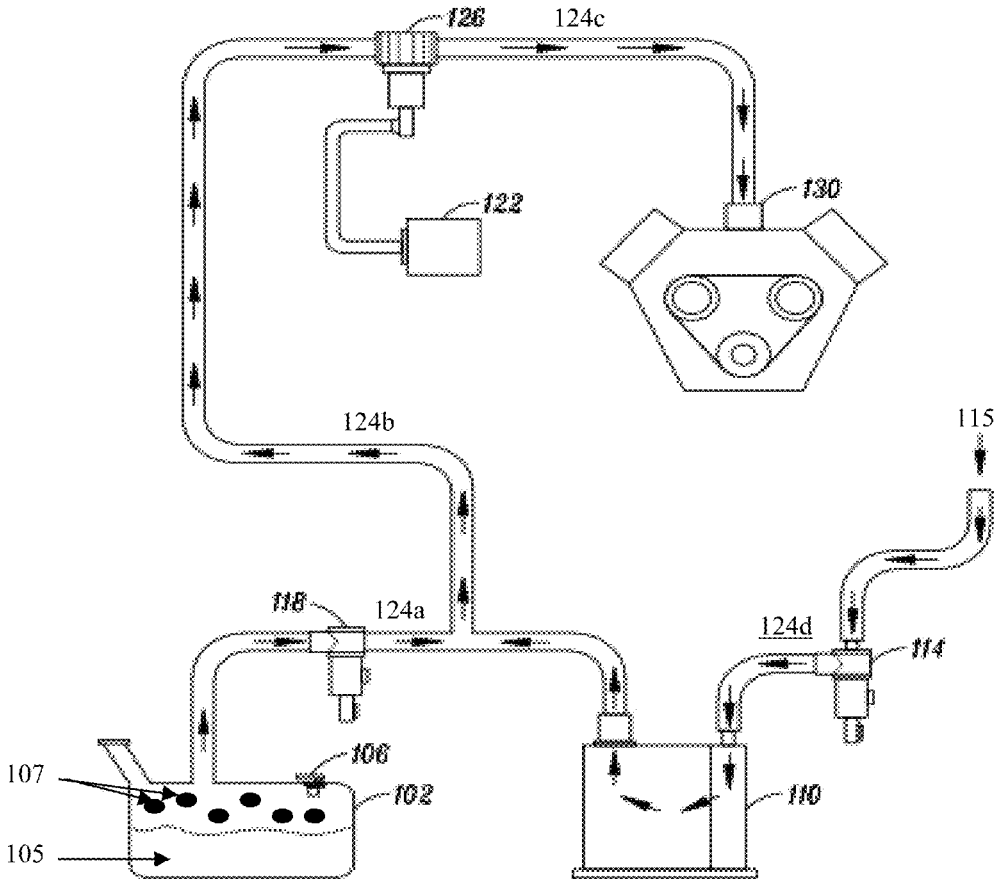
FIG. 1 is a schematic view of a conventional Evaporative Emission Control System configured to reduce evaporative emissions through a vehicle.

FIG. 1 illustrates a conventional evaporative emissions control system 100. As seen there, the system is made up primarily of a fuel tank 102, a carbon canister 110, and the engine intake manifold 130, all joined by lines and valves. It will be understood that many variations on this design are possible, but the illustrated embodiment follows the general practice of the art. It will be further understood that the system 100 is generally sealed, with no open vent to atmosphere.

Fuel tank 102 is partially filled with liquid fuel 105, but a portion of the liquid will evaporate over time, producing fuel vapor 107 in the upper dome portion of the tank. The amount of vapor produced will depend upon a number of environmental factors. Of these factors, ambient temperature is probably the most important, particularly given the temperature variation produced in the typical diurnal temperature cycle. For vehicles in a warm climate, particularly a hot, sunny climate, the heat produced by leaving a vehicle standing in direct sunlight can produce very high pressure within the vapor dome of the tank, producing huge amount of vapors within the fuel tank. A fuel tank pressure sensor (FTPT) 106 monitors the pressure in the fuel tank vapor dome.

Vapor lines 124 join the various components of the system. One portion of that line, line 124*a* runs from the fuel tank 102 to carbon canister 110. A normally-closed Fuel tank isolation valve (FTIV) 118 regulates the flow of vapor from fuel tank 102 to the carbon canister 110, so that vapor generated by evaporating fuel can be adsorbed by the carbon pellets under control of the PCM 122. Vapor line 124*b* joins line 124*a* in a T intersection beyond valve 118, connecting that line with a normally closed canister purge valve (CPV) 126. Line 124*c* continues from CPV 126 to the engine intake manifold 130. Both CPV 126 and FTIV 118 are controlled by signals from the powertrain control module (PCM) 122.

Canister 110 is connected to ambient atmosphere at vent 115, through a normally closed canister vent valve (CVV) 114. Vapor line 124*d* connects that vent 115 to the canister 110. Valve 114 is also controlled by PCM 118.

During normal operation, valves 118, 126, and 114 are closed. When pressure within vapor dome of the fuel tank 102 rises sufficiently, under the influence, for example, of increased ambient temperature, the PCM opens valve 118, allowing vapor to flow to the canister 110, where carbon pellets can adsorb fuel vapor.

To purge the canister 110, valve 118 is closed, and valves 126 and 114 are opened. It should be understood that this operation is only performed when the engine is running, which produces a vacuum at intake manifold 130. That vacuum causes an airflow from ambient atmosphere through vent 115, canister 110, and CPV 126, and then onward into intake manifold 130. As the airflow passes through canister 110, it entrains fuel vapor from the carbon pellets. The fuel vapor mixture then proceeds to the engine, where it is mixed with the primary fuel/air flow to the engine for combustion.

Figure 2:
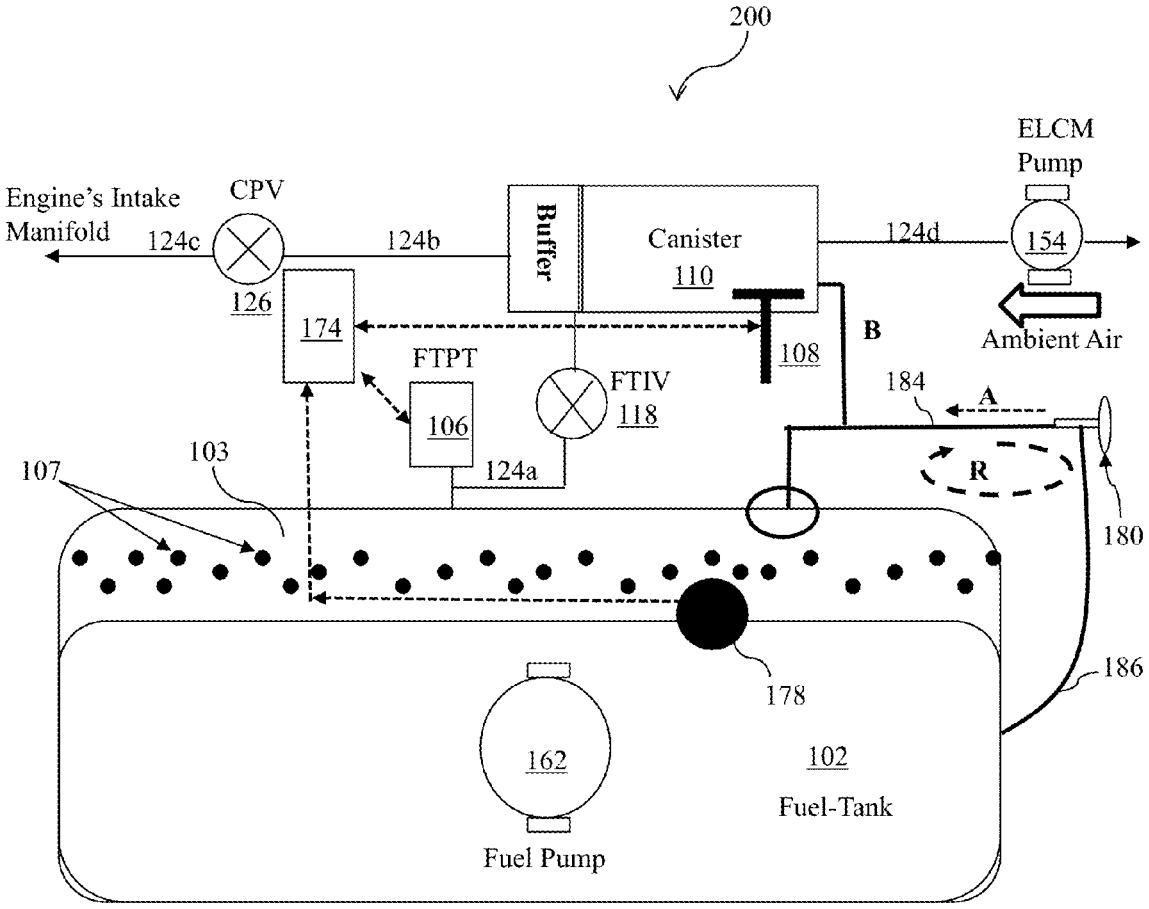
FIG. 2 illustrates an Evaporative Emission Control System, in accordance with the present disclosure.

FIG. 2 is a schematic view of an Evaporative Emission Control System 200 of the present disclosure. The following description sets forth the structural and functional differences between the system 200 and the conventional EVAP system illustrated earlier in FIG. 1.

First, as can be seen in the schematic, a temperature sensor 108 is coupled to the canister 110, for measuring its interior temperature. That sensor remains activated both during and after refueling, to measure canister temperature. Any of the widely used types of thermocouples can serve as the temperature sensor 108. The dimensions of the thermocouple and the conductors/alloys joined to make the thermocouple, impart it sufficient capabilities to accurately measure a wide range of canister temperature variations during refueling, without any significant errors.

Though only one temperature sensor 108 is shown, some embodiments may employ multiple such sensors, positioned at different location within the fuel tank 102. In such embodiments, an average of the temperature values detected by the different sensors will provide a more precise measure of the temperature within the interior of the fuel tank 102.

A controller 174 is connected to the temperature sensor 108, and monitors temperature signals from the sensor 108, to identify any substantial changes in the canister temperature during refueling. Further, the controller 174 is coupled to the FTPT 106, to analyze the response of the FTPT to any changes in fuel vapor pressure within the vapor dome 103 of the fuel tank 102.

To perform EVAP leakage detection, the system 200 includes an Evaporative Leakage Check Module (ELCM). ELCM includes a pump 154, which may be a vacuum pump of the type commonly employed by the art to evacuate EVAP systems. Each time the ELCM performs a self-diagnostic leakage check, the ELCM pump 154 evacuates the EVAP system and components.

The fuel tank 102 employs a fuel level indication sensor 178, to monitor fuel level. The indication sensor 178 may be a sensing unit having a float meter installed within the fuel tank 102. That may be any of the variety of such devices known and available to the art. As the level of fuel within the fuel tank 102 drops, the sensor 178 signals the current fuel level. Further, the indication sensor 178 is coupled to an indication unit over the dashboard of the vehicle, which indicates the level of fuel currently remaining within the fuel tank 102.

A recirculation tube 184 is coupled at one end to the canister 110, and at the other end, to a fuel filler cap 180, located on the exterior of the vehicle and opening to filler neck 186, which directs incoming fuel into the fuel tank 102. T Recirculation tube 184 tube recirculates fuel vapors during refueling, as indicated by the dotted circular arrow 'R.', As noted above, the vapor dome 103, the space above liquid fuel 105 within fuel tank 102, contains a mixture of air and fuel vapor 107. As fuel is added, and the liquid level rises, the vapor must escape the fuel tank, and thus FTIV 118 is opened for that purpose. It will be understood that vapor flowing through FTIV 118 proceeds to canister 110, where paper is adsorbed by carbon pellets. Additionally, the refueling process generates all fuel vapors, owing to the turbulent, slashing action of the fuel pouring into tank 102. When the fuel tank returns to equilibrium after refueling, a considerable proportion of the already existing vapors, as well as the newly generated vapors, could wreak and dancing to the liquid fuel. If all of the generated vapors were routed to canister 110, however, carbon pellets would adsorb the hydrocarbons before they had the opportunity to re-condense.

Recirculation tube 184 provides an alternate pathway for the fuel vapor. A certain amount of back pressure exists in the fluid passageway running through FTIV 118 and then onward through canister 110; conversely, the flow of fuel into filler neck 186 actually induces some negative pressure within recirculation tube 184. Thus, a considerable volume of fuel vapor can flow through recirculation tube 184 and into filler neck 186, where it can be entrained in, and condense into, the flow of fuel into tank 102. The size, shape and curvature of the recirculation tube may vary in different embodiments, based on factors such as the capacity and type of the fuel tank, and the positioning of the canister with respect to the fuel tank. In case of bottom feeding tanks, for example, the recirculation tube may be comparatively longer.

A blocked recirculation tube 184 forces the entirety of the fuel vapor flow toward canister 110, which can result in the canister become saturated. After saturation, any further fuel vapor entering the canister will be vented to atmosphere, causing pollution. Such a blockage could be caused by contaminants within the tube, or by excess fuel within the fuel tank 102. With the fuel tank blocked, the EVAP system will not be able to detect any possible leakage in the fuel cap area, which could lead to a failure to detect any such leaks that were present.

Direct detection of any block within the recirculation tube 184 would be difficult, as can be readily imagined. Rather than employing direct methods, the present disclosure takes advantage of the fact that fuel vapor adsorption within canister 110 is an exothermic process. Thus, canister temperature rise is proportional to the volume of vapor being adsorbed in the canister, and that measure can be used to identify a recirculation tube blockage.

It should initially be noted that the temperature rise seen in canister 110 during refueling depends upon a number of factors in addition to those employed in the present disclosure. For example, an important factor is the state of carbon loading before the refueling starts. The carbon loading state indicates the amount of hydrocarbons already absorbed by the carbon pellets before refueling. For example, a substantially saturated canister, which had not been purged for a considerable time, may have an initial loading state of 90-100%. Conversely, a canister having fresh carbon pellets would have a comparatively much lower initial loading state. The initial canister loading state also depends on the mass of carbon pellets contained within it, as a larger mass has a capacity to adsorb more hydrocarbon vapors, and hence, would have a comparatively lower initial loading state with the same amount of hydrocarbon vapors adsorbed.

It will be readily appreciated that carbon loading, while important, cannot be readily measured before refueling. A method of measuring carbon loading does exist—briefly opening the CPV would send a small amount of atmospheric air through the canister and into the engine intake manifold. That air would entrain hydrocarbons from the carbon pellets, and those hydrocarbons would briefly enrich the fuel mixture being fed to the engine. That increased richness would immediately be sensed by the O2 sensors mounted in the exhaust manifold to control the engine fuel mixture. Thus, a control routine could be implemented in this manner, but one could not guarantee that the engine would be run immediately before refueling, which would be required in order to run such test.

It can be said, however, that canister overloading would only be a problem if the hydrocarbon pellets were completely saturated. In actual operation, the decision to refuel is generally spurred by actually running the engine, and running the engine would produce at least some degree of canister purging.

Operation of the system set out in FIG. 2 proceeds as follows. First, the temperature sensor 108 detects the interior temperature of the canister 110, before the tank 102 is refueled, and provides corresponding temperature signal to the controller 174, which stores the temperature value in memory. Temperature sensor 108 may be any of the various types of temperature sensors available to the art. In the illustrated embodiment, temperature sensor 108 is a simple thermocouple, mounted in the vapor flow path within canister 110.

Next, the fuel level indication sensor 178 detects the amount of fuel dispensed into the fuel tank. The sensor 178 provides the corresponding fuel level signal to the controller 174, and the controller stores that value.

After refueling, the controller 174 obtains the canister's final temperature from the temperature sensor 178. The controller then evaluates the rise in canister temperature during the refueling process.

Some embodiments may reflect a desired to more accurately measure the canister temperature rise. To accomplish that, multiple temperature sensors of the type 108 may be disposed at different locations within the canister 110. On obtaining temperature values from all such sensors, the controller 174 may average those temperature values for accuracy.

In an embodiment, the database of controller 174 prestores corresponding to different initial canister temperature values. Those anticipated values may be based on several factors, such as the volume of fuel filled within the tank, and the canister capacity. For example, one system test indicated that during refueling, a system having an initial canister loading state of 2%, and pumping about 10 gallons of fuel into the fuel tank, the canister gained about 10° F., from about 68° F. to 78° F. That test proceeded with and operational recirculation tube, having no blockage. With a blocked or broken recirculation tube, however, and introducing the same volume of fuel to the fuel tank, it was observed that the canister temperature rose by about 60° F. That result was caused by the additional hydrocarbon vapors adsorbed by the canister during refueling, which vapors would have been otherwise recirculated.

It is contemplated that the anticipated canister temperature rise values stored within the controller's database, may vary in different embodiments, based on several factors such as those mentioned above, and therefore, the above experimentally obtained data is merely for the purpose of explanation and understanding.

The rise in canister temperature during refueling also depends upon the fuel type, as the heat of adsorption of adsorption of fuel vapors is based on the fuel type.

Eventually, the processor of the controller 174 compares the actual canister temperature rise during refueling, with a corresponding anticipated temperature rise value stored in controller's database. If the two values match substantially, the controller infers that the recirculation tube is operative reliably, and that it has no blockage. If the two values differ by more than a pre-determined value, however, then the recirculation tube is unreliable, and carries a blockage. The predetermined value is simply the difference between the initial canister temperature and the pre-stored anticipated final temperature value.

Figure 3:
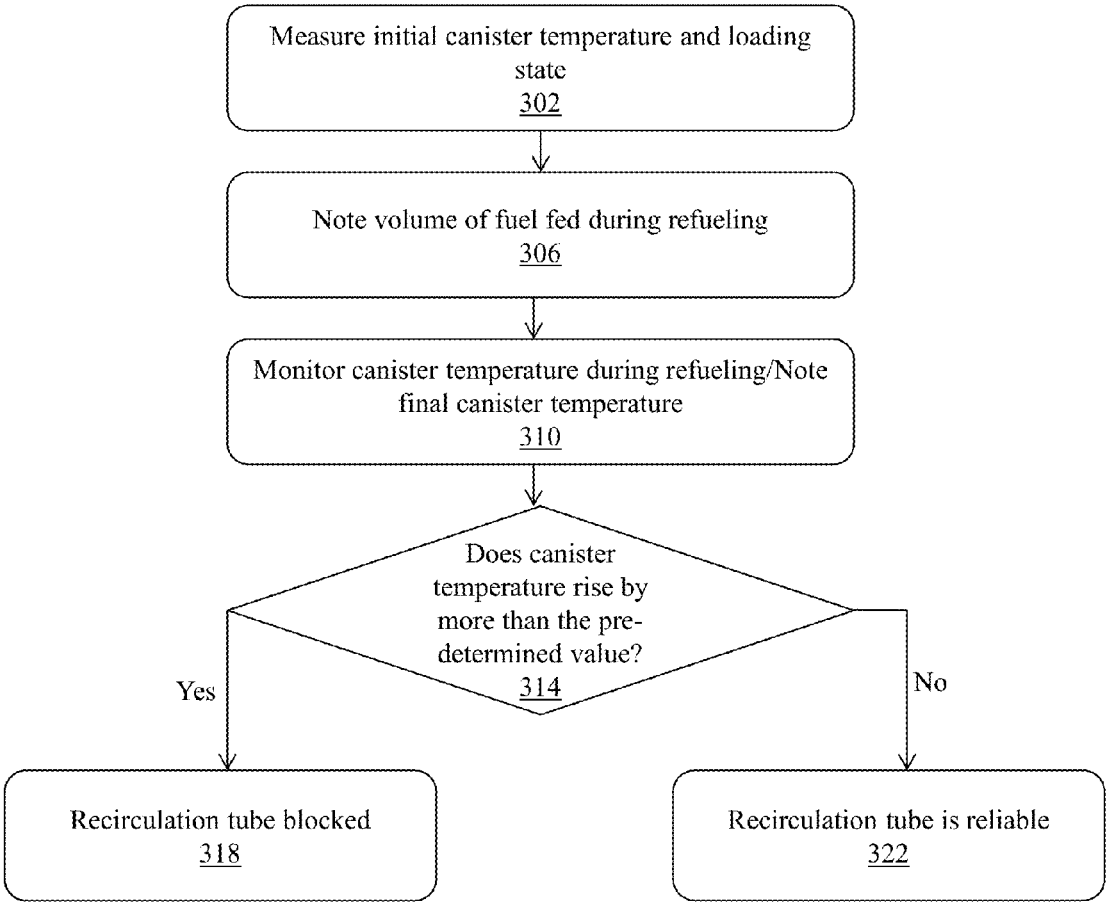
FIG. 3 is a flow chart depicting the different steps involved in a method for detecting blockage within a recirculation tube of the EVAP system of a PHEV, according to the present disclosure.

FIG. 3 is a flowchart depicting a method for detecting a blockage within recirculation tube 184 of EVAP system 200. At the initial step 302, the method detects the initial canister temperature.

Step 306 is initiated during refueling, where the method notes the amount of fuel dispensed into the fuel tank. As mentioned earlier, the fuel level indication sensor 178 provides fuel level signals to the controller 174 during and after refueling, and the controller stores that value. Thus, the controller 174 can calculate the volume of added fuel.

At step 310, the temperature sensor 108 detects the canister temperature continuously during refueling, to measure the temperature rise. In some embodiments this step can be performed only at the close of refueling, but monitoring during refueling can provide warning of a possible fuel emission, which can be triggered by a large temperature rise, for example.

At step 314, the method compares the rise in canister temperature to a pre-determined temperature value. To effect that, in an embodiment, the controller 174 may compare the observed temperature rise to an anticipated temperature rise value pre-stored in its database. That anticipated value depends on several factors, such as the amount of fuel dispensed during refueling.

If the observed canister temperature rise is more than the pre-determined value, then at step 318, the method concludes that the recirculation tube is unreliable, and blockage exists in it. However, if the observed rise in temperature is equal to or below the pre-determined value, then at step 322, it is concluded that the recirculation tube is reliably operative, and no blockage exists in it.

Figure 4:
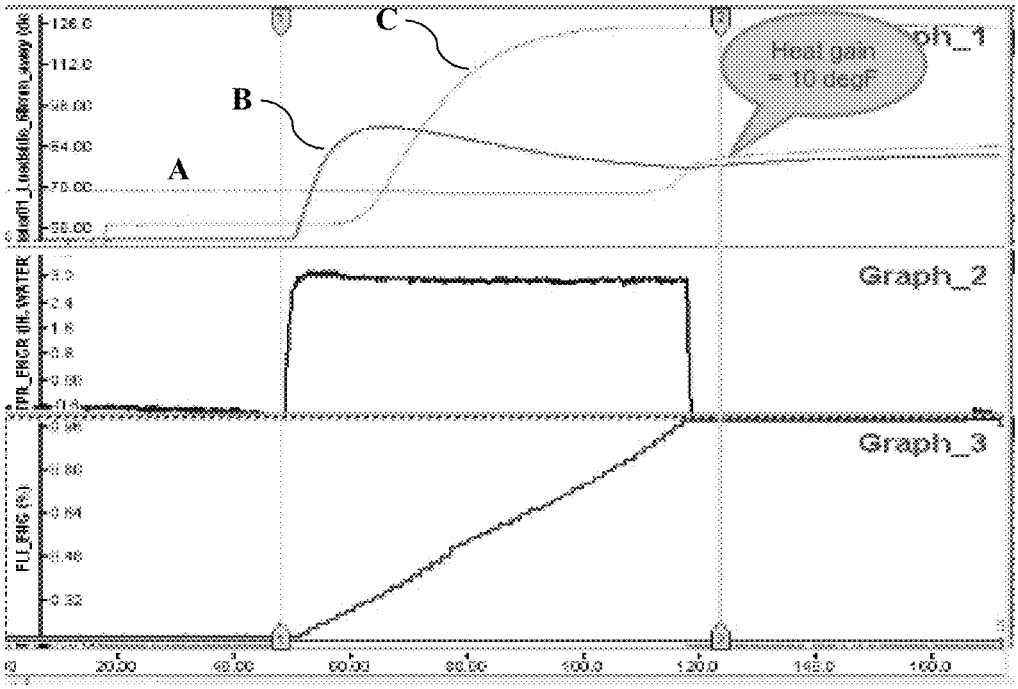
FIGS. 4(A) and 4(B) are graphs illustrating changes in canister temperature under different operating conditions of the present disclosure.
Figure 4:
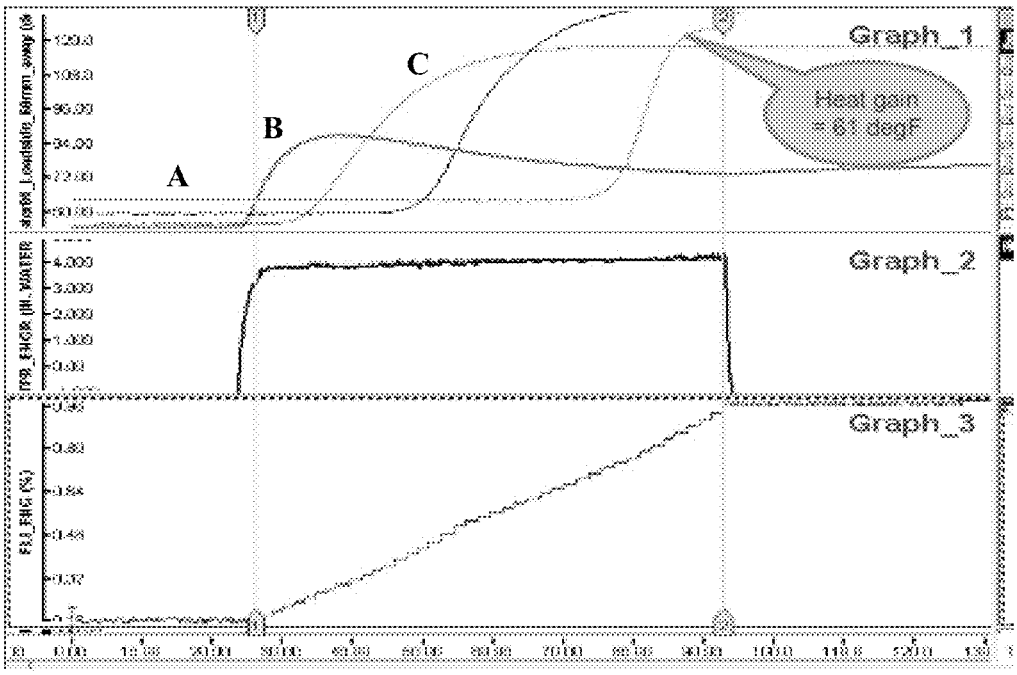

FIG. 4(A) is a graph representing the variation in the canister temperature of an EVAP system, in response to refueling, in case of a reliably operative recirculation tube. Graph 1 represents the rise in canister temperature measured through thermocouples of different lengths, Graph 2 in the middle represents pressure within the fuel tank 102, and Graph 3 at the bottom represents fuel dispensed into the fuel tank. Signals from fuel level indicator 178 can be calibrated in volume units (gallons, liters, etc.) or they can indicate percentages of the total tank volume, values that can be converted to actual volume. Curves A, B and C in the top graph represent the trend of variation in the canister temperature, as measured through thermocouples at locations 200 mm, 60 mm and 95 mm along the vapor path, respectively. Curve 'A' indicates that with an initial canister temperature of 70° F., the 200 mm thermocouple detected a temperature gain of about 10° F. by the time the fuel tank was 100% filled. Similarly, curve 'C' indicates that with an initial canister temperature of 56° F., the 95 mm thermocouple registered a temperature rise to about 117° F., by the time the fuel tank was 90% full.

FIG. 4(B) is a graph representing the variation in the canister temperature, for a case where the recirculation tube of the EVAP system is blocked or disconnected. There, it can be seen through curve 'A' that with a similarly-positioned thermocouple, and almost same initial canister temperature, the observed temperature rise is about 61° F. during refueling. Here, a larger volume of hydrocarbon vapors was adsorbed by the canister, because the recirculation tube was blocked or unplugged.

The trend of canister temperature variation shown in these graphs is based on experimental data obtained for a specific EVAP system, operating under one set of conditions, such as a specific canister size, capacity and initial loading state. Therefore, the observed trend of variation and the amount of canister temperature rise may vary in different embodiments, based on the experimental conditions.

The method and the system of the present disclosure is highly effective in recirculation tube diagnostics for EVAP systems in PHEVs, and easily identifies any blockage being present in such recirculation tubes, which may be due to factors such as presence of contaminants within the tube, or due to excessive fuel being present within the fuel tank.

Although the current invention has been described comprehensively, in considerable details to cover the possible aspects and embodiments, those skilled in the art would recognize that other versions of the invention are also possible.

What is claimed is:

1. A method for verifying reliable operation of a recirculation tube of an evaporative emission control system of a plug-in hybrid electric vehicle, the recirculation tube having a first end connected to a fuel-filler neck of the vehicle fuel system, and a second end connected to a canister of the evaporative emission control system, the method comprising:

detecting refueling, employing a fuel level sensor, and inputting to a controller a signal corresponding to the change in fuel level during refueling;

measuring canister temperature at least before, and after refueling, employing a temperature sensor, inputting signals corresponding to the measured canister temperature to the controller, and storing the temperature signals;

determining whether the recirculation tube is blocked, employing the controller, including processing the stored temperature signals to determine an actual refueling temperature differential;

processing the fuel level signals, together with pre-calculated fuel-related data to determine an anticipated refueling temperature differential;

comparing the actual refueling temperature differential with the anticipated refueling temperature differential to calculate the mismatch between those values, and in the event that the mismatch exceeds a predetermined value, outputting a signal to the evaporative emission control system indicating that the recirculation tube is blocked.

2. The method of claim 1, wherein the pre-determined temperature value is based on one or more of:

the initial loading state of the canister;

the type and the amount of fuel filled within the fuel tank during refueling; or the initial canister temperature, before refueling.

3. The method of claim 1, further comprising, positioning multiple temperature sensors at different locations within the canister, to measure the rise in canister temperature during refueling.

* * * * *